United States Patent [19]

Stroh

[11] Patent Number: 5,022,110

[45] Date of Patent: Jun. 11, 1991

[54] LOW AIR LOSS MATTRESS

[75] Inventor: Glenn C. Stroh, Marion, Tex.

[73] Assignee: Kinetic Concepts, Inc., San Antonio, Tex.

[21] Appl. No.: 338,943

[22] Filed: Apr. 17, 1989

[51] Int. Cl.[5] ..... A61G 7/04

[52] U.S. Cl. ..... 5/455; 5/458; 5/465; 5/468

[58] Field of Search ..... 5/421, 423, 453, 455, 5/456, 464, 465, 468, 469

[56] References Cited

U.S. PATENT DOCUMENTS

| | | | |
|---|---|---|---|
| 1,668,373 | 5/1928 | Krasity | 5/465 |
| 2,069,422 | 2/1937 | Sampson | 5/449 |
| 2,269,342 | 1/1942 | Johnson | 5/458 |
| 2,731,652 | 1/1956 | Bishop | 5/457 X |
| 3,428,974 | 2/1969 | Stuart | 5/455 |
| 3,667,073 | 6/1972 | Renfroe | 5/469 X |
| 3,678,520 | 7/1972 | Evans | 5/453 |
| 3,740,277 | 6/1973 | Dee | 5/469 X |
| 3,757,366 | 9/1973 | Sacher | 5/469 X |
| 3,778,851 | 12/1973 | Howorth | 5/423 |
| 4,054,960 | 10/1977 | Pettit et al. | 5/455 X |
| 4,149,285 | 4/1979 | Stanton | 5/453 |
| 4,193,149 | 3/1980 | Welch | 5/453 X |
| 4,267,611 | 5/1981 | Agulnick | 5/453 |
| 4,391,009 | 7/1983 | Schild et al. | 5/453 |
| 4,483,030 | 11/1984 | Flick et al. | 5/458 |
| 4,766,629 | 8/1988 | Schueler | 5/455 X |
| 4,788,730 | 12/1988 | Bexton | 5/455 X |
| 4,797,962 | 1/1989 | Goode | 5/453 |

FOREIGN PATENT DOCUMENTS

| | | |
|---|---|---|
| 1545806 | 5/1979 | United Kingdom . |
| 2134379 | 8/1984 | United Kingdom . |

OTHER PUBLICATIONS

Advertisement for "EHOB" body support, EHOB Inc., 1725 N. Shadeland Ave, Indianapolis, Ind. 46219, date unknown.

*Primary Examiner*—Michael F. Trettel
*Attorney, Agent, or Firm*—Cox & Smith Incorporated

[57] ABSTRACT

A low air loss mattress 20 made of multiple cushions 21, 22 and 23 which are connected together and which form an integral mattress which may be used on a standard hospital bed. Each section 21, 22, and 23 is formed by sewing together upper and lower sheets 27 and 28, 29 and 30, and 31 and 32, which sheets are also connected by multiple retaining means 50 which act as air vent means to allow air to escape in the area where a patient lies to provide comfort to the patient and to allow pressure regulation in each of the cushions.

25 Claims, 3 Drawing Sheets

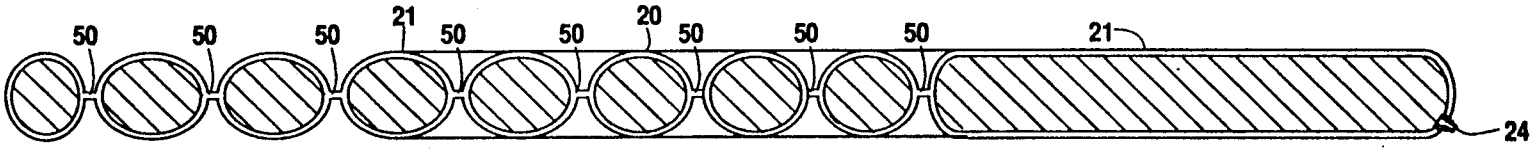
Fig. 11
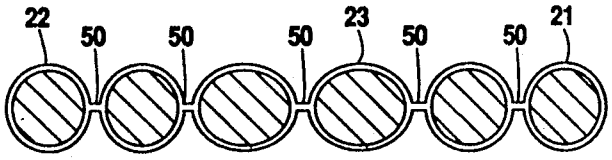
Fig. 12
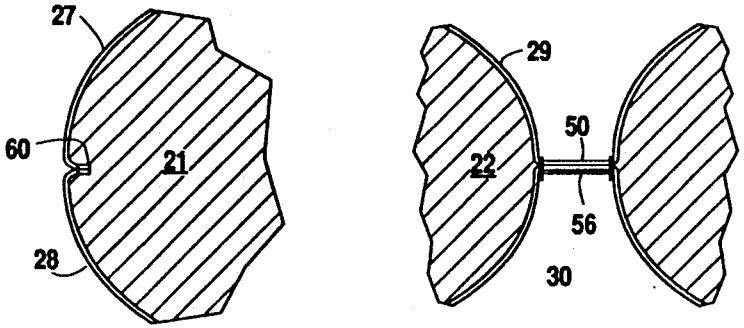
Fig. 13
Fig. 14
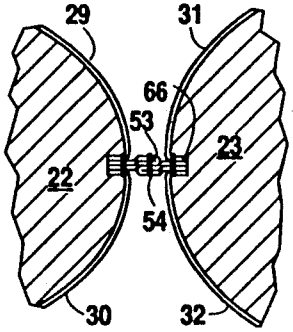
Fig. 15
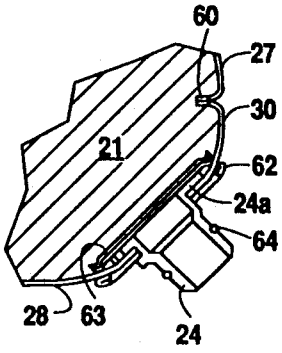
Fig. 16

LOW AIR LOSS MATTRESS

BACKGROUND OF THE INVENTION

The invention relates generally to low air loss support systems and more particularly to a low air loss mattress which may be used on standard hospital beds.

In recent years, low air loss beds have come into extensive use and are commonly used in hospitals to prevent and treat the symptoms of immobility. Low air loss beds have been marketed by several companies like Mediscus Products Limited, Kinetic Concepts, Inc., Air Plus, Inc., and SSI Medical, Inc. The products currently in use generally cost in excess of $10,000.00. However, the most common method of marketing today is to rent these beds to patients in hospitals which is reimbursed by insurance, Medicare, or Medicaid. Typical rental fees may be $50.00 or more per day. Few hospitals are willing or able to make the large capital expenditures necessary to maintain sufficient low air loss beds to supply patients.

There have been many other devices which have been utilized to attempt to prevent or treat the symptoms of immobility. A common symptom of immobility is decubitis ulcers which are commonly referred to as bed sores. A primary cause of bed sores is the inability of the patient to move so as to relieve pressure points. These pressure points typically occur in the area of a boney protruberence which results in a cut-off of the blood flow in the skin adjacent to the protruberence when capillary pressure is insufficient to provide blood flow. When the blood flow in the capillaries is blocked due to the pressure, the cells in that area begin to die and may result in the sore or wound which is called a bed sore. Non-immobile persons do not have this problem because they continually move even when asleep which eliminates the cut-off blood flow for too long a period.

Many types of devices have been used to increase the comfort of an immobile patient. These have taken the form of feathers or other types of stuffing material. In more recent years, foam has been used as well as innerspring mattresses. While these devices are useful for individuals who are not immobile, they do not provide adequate care for immobile patients. Many devices have been utilized with limited degrees of success to prevent or treat bed sores. Egg-crate type foam has been commonly used although its therapeutic value is questionable. Similar alternating pressure pads have been used. Both have the advantage of being very inexpensive. Waterbeds have also been used, but a waterbed suffers from the hammocking effect where the patient assumes a similar orientation to that of an individual in a hammock suspended between two points. Other types of devices which have been proposed have been non-fluidized sand beds. While the egg- crate foam has been commonly used, waterbeds and other types of similar devices have not met with much commercial success nor are they considered to be of much therapeutic value.

In the early 1960's, studies were conducted in England by a Professor John T. Scales on the treatment of burn patients who had received skin grafts. When a burn patient receives a skin graft, it is not possible to apply any type of shear to the graft which will result in dislocation of the skin graft or layer of skin which has been grafted onto the burned area. This will often result in failure of the graft. Professor Scales originally proposed completely supporting a patient on a high volume of air similar to the principle of a hovercraft. This type of device became known as the levitation bed and is shown in U.S. Pat. No. 3,354,476 issued to John P. Scales. The levitation bed which became known as the high air loss bed was further perfected in England as shown in U.S. Pat. Nos. 3,340,550 and 3,340,551 issued to Leslie A. Hopkins. Professor Scales and Mr. Hopkins worked together on these devices in the middle 1960's when Professor Scales was at Mt. Vernon Hospital and Mr. Hopkins was at Hovercraft Development, Ltd. Mr. Hopkins was a hovercraft skirt expert and utilized his expertise in this area to make the first workable high air loss bed which has been reported in medical journals. While the high air loss bed would support a patient on a very high volume of air and prevent any shear or damage to the skin, it proved to be impractical. It required a very high volume of air that had to be heated and humidified and was very costly to operate. While sound in theory, the high air loss bed was commercially doomed. Although tests were performed with the high air loss bed, it was eventually abandoned around 1970. In 1968, Mr. Hopkins invented what is now called the low air loss bed. This device is shown in British Patent No. 932,779. This device was further perfected by Professor Scales as shown in U.S. Pat. No. 3,822,425 which called for the use of water vapor permeable but water vapor proof fabric.

At about the same time that Professor Scales and Mr. Hopkins were working on the high air loss bed and low air loss bed, Mr. Thomas S. Hargest came up with the air fluidized bed or Bead bed. This is shown in U.S. Pat. No. 3,428,973. Although a geologist by training, Mr. Hargest began work as a clinical engineer in Galveston, Tex. at the burn hospital and with the assistance of several physicians adapted general air fluidized bed technology, which was typically used for sandblasting reservoirs to make a bed which would support a patient. The bead bed had the advantage of little, if any shear which was very useful for burn patients.

The low air loss bed and the air fluidized bed share the common feature of distributing the support of a patient over a much larger surface area of the patient and thus reducing any pressure Points that would exceed caPillary Pressure and reduce blood flow to the point of damage to the skin. While both the low air loss bed and the air fluidized bed grew out of research in burns, it soon became apparent that they were also useful for just treating patients that suffered from immobility. Although both were invented in the late 1960's, neither the low air loss bed nor the air fluidized bed enjoyed much commercial success for over ten years.

In the 1970's, several other devices were devised which were of some use in treating and preventing the symptoms of immobility. These devices including the oscillating bed which was invented by Dr. Frances X. Keane which is shown in U.S. Pat. No. 3,434,165. Another such device was the net bed such as shown in U.S. Pat. No. 4,357,722. Other devices included the stryker brand frame. There was also the Circle Electric bed. In addition to these devices, various alternating pressure pads came into use such as the ones marketed by Gaymar. While these devices have some therapeutic value, they have apparently yet to achieve the commercial success as low air loss beds and air fluidized beds in treating and preventing immobility.

There have been many improvements made in the low air loss bed which was invented by Mr. Hopkins and Professor Scales. Much of this work was done at Air Cushion Equipment, Ltd. which was owned and operated by Mr. Leslie A. Hopkins. Mr. Roy Henvest, Mr. Robert Cook, and Mr. Graham Westerling-Norris all contributed improvements to the low air loss bed. Improvements in the low air loss bed were also made by Mr. Frank Ducker and Mr. William B. Hunt at Mediscus Products, Ltd. who made the first commercial low air loss bed in about 1973.

For many years, there have been attempts at making an inexpensive device that would serve the purpose of the low air loss bed. Air fluidized beds which typically weigh as much as one ton could not be considered in the same category as low air loss beds, particularly the portable type. These attempts began with Mr. Hopkins as early as 1968 and continued by Mr. Hopkins at Air Cushion Equipment Limited for almost ten years. They were carried on by Mr. Robert Cook at Air Cushion Equipment Limited and then later by Mediscus Products, Ltd. who made several attempts at making an inexpensive low air loss support surface. In lieu of no commercially practical low air loss support mattress, the other devices described above such as alternating pressure pads, egg-crate foam, and other devices of questionable therapeutically effect have been substituted. While the net bed is usable in certain situations, it similarly has not achieved any significant commercial success and has not been accepted as being as therapeutically effective as the low air loss bed or the air fluidized bed.

From the beginning, it was Mr. Hopkins' dream to build a poor man's low air loss bed. This is exemplified in his initial low air loss device shown in his original patent which was little more than a mattress. However, the direction of development did not go that way and beds after Mr. Hopkins' initial bed were generally full-sized beds with complete frames. Mr. Hopkins again Proposed a form of portable low air loss bed in about 1976, when he was a consultant to Mediscus Products Limited which is shown in British Pat. No. 1,545,806. Design work continued at Air Cushion Equipment, Limited in the middle 1960's on the portable low air loss bed and most of the design was made by Mr. Robert Cook. Air Cushion Equipment, Limited was retained by Mediscus Products, Limited and the work there of Mr. Cook resulted in the first commercial low air loss mattress which was intended to be usable on any type of bed frame. The device which was conceived and initially constructed by Mr. Cook at Air Cushion Equipment, Limited is exemplified in U.S. Pat. No. 4,525,885. Another attempt at a less expensive low air loss bed is shown in British Pat. No. 2,134,379B. None of these devices have enjoyed any commercial success, in particular the device shown in U.S. Pat. No. 4,525,885 was commercially abandoned because of hygiene problems.

A more recent attempt at an inexpensive support mattress is shown in U.S. Pat. No. 4,803,744 which is assigned to Hill-Rom Company which is the largest hospital bed manufacturer in the United States. As of yet, this device has not achieved any significant commercial success nor is it believed that it is likely to.

There are believed to be many thousands of patients who suffer the complications of immobility who receive no treatment on air fluidized beds or low air loss beds because of the substantial costs involved and the lack of funds. This is particularly acute in nursing homes where the products are badly needed but generally unavailable because of the cost. While many other devices such as the egg-crate foam and other types of systems have been used, they have not solved the problem nor will they ever.

It is an object of the present invention to provide a relatively low-cost and simple low air loss mattress which could be used on standard hospital beds and which is commercially practical as well as being therapeutically effective. It is another object of the invention to provide a lightweight, inexpensive mattress which is therapeutically similar to low air loss bed and the air fluidized bed but which does not cost as much to manufacture or maintain.

In his initial patent on the low air loss bed, Professor Scales proposed the use of waterproof but water vapor permeable -material. This type of material has gained widespread use with the event of Gortex brand laminate which has established itself in the medical area as being a highly effective and useful material. While air permeable Gortex is available, the most commonly used version of Gortex in low air loss beds is air impermeable but water vapor permeable. This Gortex material or laminate is typically attached to a woven nylon material. For comfort and therapeutic reasons, it is often desirable or necessary to provide air flow around the patient. It is generally accepted that skin which remains in contact with fluid is more subject to breakdown. This is readily recognized by anyone who spends a large amount of time in water which causes a wrinkling of the skin. The Gortex material largely eliminates these problems and has become widely accepted and used. There have been other types of water vapor permeable materials which have also been proposed, but they have not obtained the widespread acceptance and use as has Gortex brand material. Since the initial commercialization of the low air loss bed, one of its Iargest benefits has been considered its ability to control the environment with low air loss around the patient as well as control the pressure through the low loss of air. A patient would not find a typical air mattress to be comfortable for any extended period of time because it is typically made of material which is completely airtight and water vapor impermeable and which does not have careful pressure regulation. Furthermore, a patient would sweat and be less comfortable when in contact with a vinyl material which was generally impermeable. Others have proposed used air and water impermeable materials and punched holes in the bags or provided an air exhaust for their low air loss beds. These low air loss materials could typically be welded and thus did not have air escape holes in the air bags formed by stitch holes caused by a sewing needle.

It is an object of the present invention to combine the benefits of low air loss beds and the use of water vapor permeable material in a low cost mattress. It is also an object of the invention to provide the benefits of low air loss beds and low air loss therapy in an inexpensive mattress.

While the present invention requires an air supply blower, it is the object of the present invention to be able to utilize a relatively small and inexpensive blower. It is further an object of the invention to provide for pressure differentials in various sections of the mattress to compensate for different pressures from the body such as the legs, abdomen, and head areas of a patient. Typically, there is more weight in the buttocks area than on the heels and the head so pressure differentials are desirable in order to properly support the patient lying on the mattress.

It is another object of the present invention to provide a low cost, inexpensive low air loss support system which combines the therapeutic benefits of use of a water vapor permeable material and airflow around the patient as well as separate sections which have adjustable pressures. The intent is to achieve all of these objects with an affordable mattress that can be used on regular hospital beds or other support surfaces and which is inexpensive to manufacture and use and which may even be disposable.

Other objects of the invention will be apparent from the following detailed disclosure.

BRIEF SUMMARY OF THE INVENTION

The invention includes a low air loss therapeutic patient support system that is made up of connected air cushions which form a low air loss patient support mattress when inflated. The mattress may be used on standard hospital beds or other flat supports. The multiple cushions allow for variable pressure to support a patient and to compensate for different weights of various portions of the body of the patient. Each cushion is provided with air vents in its upper surface to provide air circulation around a patient and for pressure regulation in each cushion. Retainers are provided to prevent billowing of each cushion in its center portions and maintain a substantially level patient support surface. A small portable blower provides a constant air supply for each of the cushions and allows adjustment of the air pressure in each of the cushions to accommodate varying weights of patients on the mattress.

BRIEF DESCRIPTION OF THE DRAWINGS

FIG. 11 shows a cross-section as indicated in FIG. 1.

FIG. 12 shows another cross-section as indicated in FIG. 1.

FIG. 13 shows a detail of a Portion of FIG. 11 as indicated.

FIG. 14 shows another detail of a portion of FIG. 11 as indicated.

FIG. 15 shows another detail of a portion of FIG. 11 as indicated.

FIG. 16 shows another detail of a portion of FIG. 11 as indicated.

BRIEF DESCRIPTION OF THE PREFERRED EMBODIMENT

Figure 1:
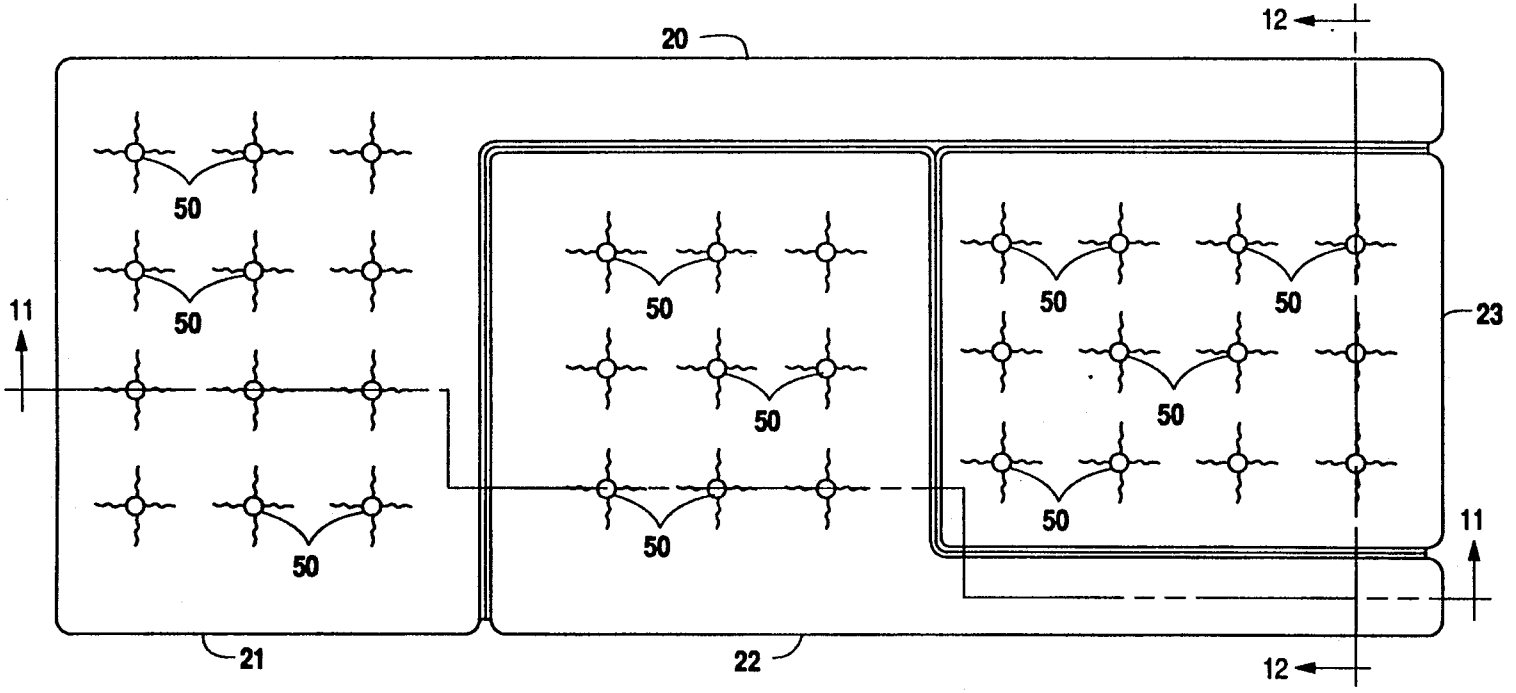
FIG. 1A shows a plan view of the mattress of the invention.
Figure 2:
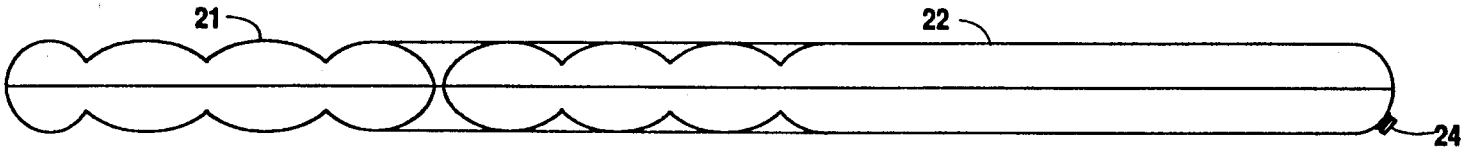
FIG. 2 shows a side elevation view of the mattress of the invention.

The low air loss mattress of the invention is generally represented as 20 in FIG. 1. The low air loss mattress 20 is made up of three cushions or sections 21, 22, and 23. Section 21 is generally referred to as the head portion, section 22 is generally referred to as the body portion and section 23 is generally referred to as the foot portion.

Figure 3:
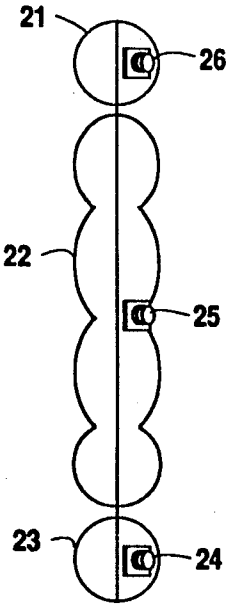
FIG. 3 shows an end elevation view of the mattress of the invention.

Each of the cushions for sections 21, 22, and 23 are provided as shown in FIG. 3 with air supply nipples 24, 25, and 26. The nipples 24, 25, and 26 are connected to air suPply hoses from a blower unit which may be mounted in the floor or hung on the side of a support bed frame. Typically, the blower unit would be a self-contained unit with three air supply hoses and three air control valves and an optional heater to supply air to each of the mattress sections. Air control valves would be provided in the blower to control the air pressure in each of the sections and thus allow adjustment of the pressure in each of the sections to provide comfort depending upon the size and weight of the patient lying on the mattress. Such air supply blowers are commonly used by numerous manufacturers of low air loss beds and typically include an air supply blower connected to an air filter. The outlet of the air supply blower is connected to a plenum chamber and three valves are connected with the plenum chamber to supply air through air supply lines to the nipples 24, 25, and 26. A heater may also be positioned within the air plenum chamber. A quick release dump valve may be Provided with a plenum chamber to dump air from the mattress for cardiac arrest procedures and the like.

The construction of the mattress is important because a very important part of the invention is its low cost and its ease of manufacture. This is made possible by the simplified construction. The mattress is constructed of the components generally shown in FIGS. 4, 5, 6, 7, 8, 9, and 10. The nipples 24, 25, and 26 shown in FIG. 3 also form a part of this construction. The components are sewn together using commercial sewing machines. The needles of each sewing machine forms stitch holes which allow air to vent from the mattress. The first commecially available low air loss beds similarly had air bags which were stitched and used the stich holes for some air loss. Commercial seam sealers are commonly available to seal the seams and stitch holes as desired by adhering a narrow tape-like material thereto using a blast of hot air. This technique is commonly used for sealing the seams and sealing the seams and stitch holes of water permeable but water-proof articles of clothing.

Figures 4, 5, 6, 7, 8, 9, 10:
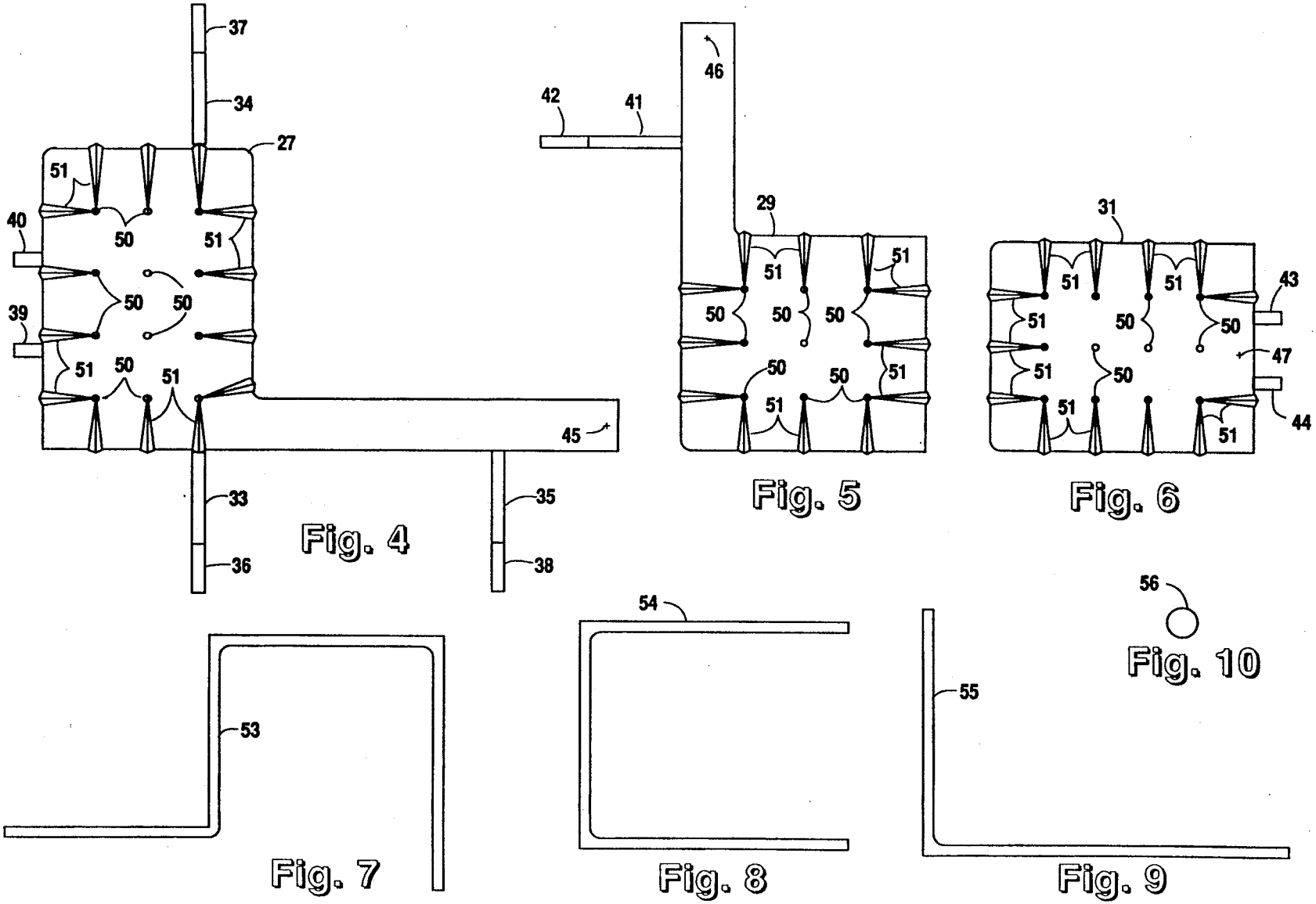
FIG. 4 shows one half of one of the head sections of the mattress.
FIG. 5 shows one half of one of the abdomen sections of the mattress.
FIG. 6 shows one half of one of the foot sections of the cushions of the mattress.
FIG. 7 shows a strip used to connect the cushions.
FIG. 8 shows another strip used to connect the cushions.
FIG. 9 shows another strip used to connect the cushions.
FIG. 10 shows a reinforcing and sealing patch that is used for of the retainers.

Generally, the mattress comprises stitching together upper and lower sections or sheets. Cushion 21 includes an upper sheet 27 shown in FIG. 4 and a lower sheet 28 shown in FIG. 13. The upper and lower sheets 27 and 28 are the same which simplifies construction. Similarly, sheet 22 as shown in FIG. 1 is formed of an upper sheet 29 as shown in FIG. 5 and lower sheet 30 as shown in FIG. 14. Cushion 23 is similarly formed from an upper sheet 31 shown in FIG. 6 and a lower sheet 32 shown in FIG. 15.

The section 21 includes retaining straps 33, 34, and 35 as shown in FIG. 4. Portions of hook and loop fasteners 36, 37, and 38 are secured on the retaining straps 33, 34, and 35 respectively. Additional hook and loop connectors 39 and 40 are also provided. As shown in FIG. 5, another retaining strap 41 is provided with hook and loop fastener 42 at one end. As shown in FIG. 6, hook and loop fasteners 43 and 44 are provided. The hook and loop fasteners secure the mattress to a support bed frame, regular mattress, or the like.

The nipple 24 as shown in FIG. 3 is positioned at point 45 as shown in FIG. 4 but on lower sheet 28. The nipple 25 shown in FIG. 3 is positioned at point 46 as shown in FIG. 5 but on lower sheet 30 as shown in FIG. 15. The nipple 26 shown in FIG. 3 is positioned at point 47 as shown in FIG. 6 but on sheet 32 as shown in FIG. 15.

Retainer dimples 50 are provided as shown in FIGS. 4, 5, 6, and in detail in FIG. 14. Each retainer dimple is identical so only one is shown and described in detail. The retainer dimples serve the dual purpose of preventing billowing of the mattress and also act as air vent holes to help regulate pressure in each section and to provide airflow for patient comfort. Conventional darts are provided to provide a flat and relatively smooth surface when the mattress is inflated as generally shown in FIGS. 1, 2, 3, and 11 through 16. The darts 51 are much like those used in typical clothing manufacture and sewing. The darts help prevent bunching of the material and enhance the appearance and aid in construction and manufacture. Baffle strips could also be used to connect the upper and lower sheets of each cushion. Conventional low air loss bags use horizontal baffles to prevent billowing of air bags with the stitch holes from sewing providing air vents under the patient.

As shown in FIGS. 7, 8, and 9 connector strips 53, 54, and 55 are provided to connect the six upper and lower panels of sheets shown in FIGS. 4, 5, 6, 13, 14, and 15. These consist of flat strips of material which are used to connect the free sections which are formed of the upper and lower sheets. A flat piece of sealing patch material 56 as shown in FIG. 10 is provided to help form the vents or retainers 50. The detailed construction of the mattress is best shown in FIGS. 11–16 which show details of the completed mattress that is made from the components shown generally in FIGS. 4–10. FIG. 13 shows a detail of mattress section 21 as shown in FIG. 11. In particular, at the edge of each of the mattress sections 21, 22, and 23, the upper and lower sections are connected together by common means such as sewing. This is shown in FIG. 13 which shows the upper and lower sections 27 and 28 sewn together at 60. The retainer dimple 50 shown in FIG. 4 is shown detail as indicated in FIG. 14. In particular, the patch 56 as shown as FIG. 10 forms the bottom of each retainer 50 and acts as a seal and reinforcement for any stitch holes which were formed in sewing the material. The patch 56 is heat sealed onto each lower sheet at each dimple to seal the stitch holes. Since the material typically comprise of water vapor permeable but waterproof material that is laminated to a woven nylon material, sewing results in needle holes which allow air to exit. The preferred material is sold under the trademark Goretex by W.L. Gore & Company. In order to limit air from exiting from the cushions 21, 22, and 23, the sealing member or patch 56 is utilized. As is apparent in FIGS. 1, 4, 5, and 6 each retainer 50 is formed generally round by sewing a circle that joins together the upper and lower sheets as 27 and 28, 29, 30, and 31, and 32. The connection detail is shown in FIGS. 13, 14, and 15. Since the circle of stitch holes in the upper portion of retainer 50 are not sealed, air exits from these vent holes and since the patient is lying above these vent holes, air will flow over the patient and provide drying and temperature control.

Strips 53, 54 and 55 as shown in FIGS. 7, 8 and 9 connect the upper and lower halves of sections 21, 22 and 23 together as best shown in detail in FIG. 15. In particular, FIG. 15 shows the detail of the connection between sections 22 and 23. In particular, flat members 53 and 54 are used to connect sections 22 and 23. Member 53 would be sewn between the connection of sheets 29 and 30 of section 22 and member 54 of FIG. 8 would be sewn between the connection 66 of sheets 31 and 32 of section 23 as shown in detail in FIG. 15. Sealing means is preferably provided where strips 53 and 54 are connected at 65 and 66 with the members 29 and 30 and 31 and 32 respectively to limit air leakage. Although connectors 53, 54, and 55 are sewn together, other connecting means might be used. Examples would be zippers and hook and loop fasteners. When made releasable from each other, the sections 21, 22, 23 might be replaced individually to permit replacement of damaged or stained sections. While it is possible to wash and disinfect a mattress, it would not likely be reused if stained with body fluids.

The details of each nipple connection is shown in FIG. 16 which shows nipple 24 connected between reinforcing strips 62 and 63 which are sewn around an opening or hole 45, as located in sheet 28 as indicated in FIG. 4. It is understood that the nipple 24 includes a flange 24A which is trapped between the strips 62 and 63 to retain it in position. An o-ring 64 may be provided on the nipple to seal with a connector as desired.

As is apparent from the above detailed disclosure, the limited number of components of the mattress provides for economy of construction and ease of manufacture. A minimum number of components is provided which are connected by conventional sewing techniques with preferably all of the needle holes and seams sealed except for the upper sheets of the cushion at the dimples to reduce air low. Reducing air loss by the sealing of most of the stitch holes and seams provides less air escape which reduces the size of the blower required to maintain the mattress inflated. While on regular low air loss beds, it may not be necessary to seal the seams and stitch holes formed by stitching the fabric together that forms the multiple air sacs, it is more significant in the instant invention because it helps reduce the cost of manufacture and operation of the blower less expensive.

In use, the low air loss mattress 20 shown in FIG. 1 could be placed on a standard hospital bed mattress. Alternatively, the standard mattress could be removed and the low air loss mattress 20 used in lieu of the standard mattress. The straps and connectors 33–38 and 41–42 shown in FIGS. 4–6 help secure the mattress to the frame or hospital mattress When connected with a standard blower unit the mattress would be inflated as shown in FIGS. 2, 3, 11–12. Because the retainers 50 prevent billowing, the upper surface of the mattress would be generally flat as shown in FIGS. 2, 3, 11 and 12. Since patches 56 seal lower stitch holes for retainers 50, air would generally only be allowed to flow upwardly in the area of the patient. Similarly, connections 60 shown for the section 21 and FIG. 13 and like connections at the outer edges of sections 22 and 23 could be sealed. The stitched connections 65 and 66 of members 53 and 54 as shown in FIG. 15 could similarly be sealed as could the nipple 24 as shown in detail in FIG. 16. Accordingly, most of the air loss could be limited to the upper surface area of the retainers 50 which act as air vents in the area where a patient lies as shown in FIG. 1. The air vent holes would provide cooling of the patient to provide comfort and which in the case of wounds to assist in healing of the wounds. It would also allow for venting of the mattress to allow pressure control in each of the sections or cushions 21, 22 and 23 so that they could be adjusted to accommodate patients of varying heights and weights. It is understood that with low air loss beds it is desirable to adjust the pressure in each section or group such that the patient would sink down into the mattress without bottoming on the support surface. In this way, pressure against the patient's skin (i.e., the interface pressure) would be distributed over a larger surface area and the patient would be less likely to suffer skin breakdown or bed sores.

While a blower is not shown, a blower having the same or similar components disclosed in co-pending continuation U.S. Pat. application Ser. No. 251,949, filed Sept. 29, 1988 and its foreign counterparts including PCT application Ser. No. PCT/US88/01861 filed June 1, 1988, John H. Vrzalik, inventor and entitled Method and Apparatus for Alternating Pressure of a Low Air Patient Support System which is incorporated in toto herein for all purposes by this specific reference thereto.

Other objects, features, and advantages of the invention will become evident in light of the following detailed description considered in conjunction with the referenced drawing of a preferred exemplary judgment according to the present invention.

I claim:

1. A low air loss therapeutic patient support system comprising:

a plurality of air cushions forming a low air loss patient support mattress when inflated;

each of said cushions being formed of connected upper and lower sheets with retainers for maintaining a level patient support surface; support mattress having a said retainers comprising stitching which forms stitch holes through at least the upper sheets of said cushions to provide air vents in the upper sheets of said cushions for circulating air around a patient supported on said cushions 2. The low air loss mattress of claim 1 wherein:

at the least the upper surface of the mattress is a water vapor permeable but waterproof material.

3. The air mattress as set forth in claim 1 wherein:

the mattress is formed of at least three cushions which generally correspond to the head, body and leg portions of a patient.

4. The mattress as set forth in claim 1 wherein:

each of the cushions are attached to each other to form the mattress.

5. The mattress as set forth in claim 1 wherein:

said retainers are formed by sewing dimples in the upper and lower sheets making up each cushion.

6. The mattress as set forth in claim 1 wherein: each cushion of the mattress is formed of upper and lower sheets which are sewn together to form a cushion.

7. A low air loss therapeutic patient support mattress comprising:

a plurality of adjacent air cushions formed of upper and lower connected sheets forming a low air loss patient support mattress when inflated;

each of said cushions having plural retainers positioned in spaced relation on the patient support surface;

said retainers having stitching holes forming means for allowing air to escape from at least the upper surface of each cushion to provide comfort and therapy to a patient on the inflated mattress and regulation of the air pressure in each cushion to maintain low interface pressures; and said retainers maintaining the upper and lower sheets of each cushion in limited spaced relationship to provide a generally flat patient support surface.

8. The low air loss mattress of claim 7 wherein:

at least the upper surface of the mattress is a water vapor permeable but waterproof material.

9. The air mattress as set forth in claim 7 wherein:

the mattress is formed of at least three cushions which generally correspond to the head, body and leg portions of a patient.

10. The mattress as set forth in claim 7 wherein:

each of the cushions are attached to each other to form the mattress.

11. The mattress as set forth in claim 7 wherein:

the retainers are formed by sewing dimples in upper and lower sheets making up each cushion.

12. The mattress as set forth in claim 7 wherein:

each cushion of the mattress is formed of upper and lower sheets which are sewn together to form a cushion.

13. A low air loss therapeutic patient support mattress overlay comprising:

a low air loss patient support mattress having a plurality of adjacent inflatable cushions formed of upper and lower connected sheets;

the upper sheets of each of said cushions having perforations formed therein for venting air from within the cushions unto a patient supported thereon;

each of said cushions having plural retainers positioned in spaced relation on the patient support surface, maintaining the upper and lower sheets of each cushion in limited spaced relationship to provide a generally level patient support surface;

said retainers comprising stitching threaded through said perforations in a manner such that air is able to escape through said perforations to provide comfort and therapy to a patient supported on the inflated cushions.

14. The mattress overlay of claim 13 wherein:

said retainers further allow air to escape through said perforations to provide regulation of the air pressure in each cushion for maintaining low interface pressures.

15. A low air loss therapeutic patient support mattress overlay comprising:

a low air loss patient support mattress having a plurality of adjacent inflatable cushions formed of upper and lower connected sheets;

the upper sheets of each of said cushions having perforations formed therein for venting air from within the cushions unto a patient supported thereon;

said perforations being formed by retainers which provide recesses in the upper sheets of said cushions which, due to their recessed nature, tend to be separated from direct contact with a patient supported on said cushions.

16. An inflatable patient support mattress overlay comprising:

a first inflatable cushion having an air inlet for enabling independent inflation of said first inflatable cushion;

a second inflatable cushion having an air inlet for enabling independent inflation of said second inflatable cushion; and a third inflatable cushion having an air inlet for enabling independent inflation of said third inflatable cushion;

said first, second and third inflatable cushions being joined to for an inflatable patient support mattress having a first end and a second end opposite one another, with said first inflatable cushion being disposed at the first of said opposite ends, said third inflatable cushion being disposed adjacent the second of said opposite ends, and said second inflatable cushion being disposed between said first and third inflatable cushions;

said second inflatable cushion having a primary portion and an elongate portion extending from the primary portion in a configuration such that a distal end of said elongate portion is adjacent the second of said opposite ends of said inflatable patient support mattress;

the air inlet of said second inflatable cushion being disposed in the distal end of said elongate portion.

17. The inflatable patient support mattress overlay of claim 16, further comprising:

a second elongate portion formed integral with said third inflatable cushion and extending therefrom in a configuration such that a distal end of said second elongate portion is adjacent the second of said opposite ends of said inflatable patient support mattress, wherein the air inlet of said third inflatable cushion is disposed in the distal end of said second elongate portion.

18. The inflatable patient support mattress overlay of claim 17, wherein:

said first elongate portion extends from said second inflatable cushion along a first side of said inflatable patient support mattress; and said second elongate portion extends from said third inflatable cushion along a second side of said inflatable patient support mattress, which is opposite the first side thereof.

19. The inflatable patient support mattress overlay of claim 18, further comprising:

a plurality of straps for securing said inflatable patient support mattress atop a primary support.

20. The inflatable patient support mattress overlay of claim 19 wherein said securing straps comprise:

a first strap and a second strap connected to the primary portion of said third inflatable cushion on opposite sides of the inflatable patient support mattress;

a third strap joined to said first elongate portion; and a fourth strap joined to said second elongate portion.

21. The inflatable patient support mattress overlay of claim 16 wherein said elongated portion is inflatable to help support a patient on said inflatable patient support mattress.

22. An inflatable patient support mattress overlay comprising:

a first inflatable cushion having an air inlet for enabling independent inflation of said first inflatable cushion;

a second inflatable cushion having an air inlet for enabling independent inflation of said second inflatable cushion; and a third inflatable cushion having an air inlet for enabling independent inflation of said third inflatable cushion;

said first, second and third inflatable cushions being joined in a coplanar configuration to form an inflatable patient support mattress having a first end and a second end opposite one another;

each of said inflatable cushions being formed of connected upper and lower sheets with retainers for maintaining a relatively level patient support surface;

said first inflatable cushion being disposed at the first of said opposite ends, said third inflatable cushion being disposed across the second of said opposite ends, and said second inflatable cushion being disposed between said first and third inflatable cushions;

said second inflatable cushion having a primary portion and an elongate portion extending from the primary portion along a first side of said inflatable patient support mattress such that a distal end of the elongate portion is adjacent the second of said opposite ends of said inflatable patient support mattress;

said third inflatable cushion having a primary portion and an elongate portion extending from the primary portion along a second side of said inflatable patient support mattress such that a distal end of the elongate portion of said second inflatable cushion is adjacent the second of said opposite ends of said inflatable patient support mattress;

said third inflatable cushion having a first strap and a second strap connected to the primary portion thereof on opposite sides of the inflatable patient support mattress and a third strap connected to the elongate portion thereof on the second side of said inflatable patient support mattress, and said second inflatable cushion having a fourth strap connected to the elongate portion thereof on the first side of the inflatable patient support mattress, for securing said inflatable patient support mattress atop a primary support;

said straps having hook-and-loop connectors formed at distal ends thereof;

the elongate portions of each of said second and third inflatable cushions also being inflatable to help support a patient on said inflatable patient support mattress;

the air inlet of said second inflatable cushion being disposed in the distal end of the elongate portion of said second inflatable cushion;

the air inlet of said third inflatable cushion being disposed in the elongate portion of said third inflatable cushion.

23. An inflatable patient support mattress overlay comprising:

a plurality of air cushions forming an integral patient support mattress overlay when inflated, said cushions including at least three separately inflatable cushions which generally correspond to the head, body and leg portions of a patient supported thereon, a first of said three cushions being located adjacent a longitudinal end of said mattress overlay and being separately inflatable by means of an air inlet located at said longitudinal end, a second of said three cushions being separately inflatable by means of an air inlet located at said longitudinal end adjacent a first lateral side of the first of said three cushions and a third of said three cushions being separately inflatable by means of an air inlet located at said longitudinal end adjacent a second lateral side of said first of said three cushions, the second lateral side of said first cushion being opposite the first lateral side of said first cushion.

24. The inflatable patient support mattress overlay of claim 23 wherein:

the second of said three cushions is disposed adjacent a second longitudinal end of said second mattress overlay, said second longitudinal end being opposite said first longitudinal end, the second of said three cushions being fluidly connected to said second fluid inlet by means of an elongate portion positioned along a first lateral side of said mattress overlay; and the third of said three cushions is disposed between the first and the second of said three cushions, the third of said three cushions being fluidly connected to said third fluid inlet by means of an elongate portion positioned along a second lateral side of said mattress overlay, the second lateral side of said mattress overlay being opposite the first lateral side of said mattress overlay.

25. An inflatable patient support mattress overlay essentially consisting of:

a plurality of air cushions forming an integral patient support mattress overlay when inflated, said cushions including at least three separately inflatable cushions which generally correspond to the head, body and leg portions of a patient supported thereon, each of said cushions being formed of connected upper and lower sheets with a plurality of retainers maintaining a level patient support surface, a first of said three cushions being located adjacent a longitudinal end of said mattress overlay and being separately inflatable by means of an air inlet located at said longitudinal end, a second of said three cushions being separately inflatable by means of an air inlet located at said longitudinal end adjacent a first lateral side of the first of said three cushions and a third of said three cushions being separately inflatable by means of an air inlet located at said longitudinal end adjacent a second lateral side of said three cushions, the second lateral side of said first cushion being opposite the first lateral side of said first cushion; and means for securing said mattress overlay to a mattress.

* * * * *